US005268250A

United States Patent [19]

Matsuo et al.

[11] Patent Number: 5,268,250

[45] Date of Patent: Dec. 7, 1993

[54] ELECTROPHOTOGRAPHIC PHOTORECEPTOR AND METHOD OF MANUFACTURING COMPRISING SIMULTANEOUSLY VAPOR DEPOSITING CHARGE GENERATING MATERIAL AND OLIGOMER

[75] Inventors: Minoru Matsuo, Sagamihara; Minoru Taguchi, Yokohama, both of Japan

[73] Assignee: Ricoh Company, Ltd., Tokyo, Japan

[21] Appl. No.: 870,229

[22] Filed: Apr. 20, 1992

Related U.S. Application Data

[63] Continuation of Ser. No. 554,417, Jul. 19, 1990, abandoned.

[30] Foreign Application Priority Data

Jul. 24, 1989 [JP] Japan ..... 1-188724
Jul. 31, 1989 [JP] Japan ..... 1-196921
Jan. 19, 1990 [JP] Japan ..... 2-8342

[51] Int. Cl.[5] ..... G03G 15/02; G03G 5/00

[52] U.S. Cl. ..... 430/128; 430/58; 430/127

[58] Field of Search ..... 430/58, 59, 60, 128, 430/127

[56] References Cited

U.S. PATENT DOCUMENTS 4,426,434 1/1984 Arishima et al. ..... 430/128
4,847,175 7/1989 Pavlisko et al. ..... 430/96

*Primary Examiner*—Marion E. McCamish
*Assistant Examiner*—S. Rosasco
*Attorney, Agent, or Firm*—Oblon, Spivak, McClelland, Maier & Neustadt

[57] ABSTRACT

Disclosed herein is an electrophotographic photoreceptor comprising a charge generation layer and a charge transport layer disposed in lamination on a substrate, in which at least one of said charge generation layer and said charge transport layer is a vacuum vapor deposition film containing a binding polymer.

18 Claims, No Drawings

ELECTROPHOTOGRAPHIC PHOTORECEPTOR AND METHOD OF MANUFACTURING COMPRISING SIMULTANEOUSLY VAPOR DEPOSITING CHARGE GENERATING MATERIAL AND OLIGOMER

This application is a continuation of application Ser. No. 07/554,417, filed on Jul. 19 1990, now abandoned.

BACKGROUND OF THE INVENTION

The present invention relates to a photoreceptor used for electrophotography and, more in particular, it relates to an electrophotoreceptor having an organic photoconductor layer.

The photoreceptor having an organic photoconductor layer (hereinafter simply referred to as an OPC photoreceptor) has a merit capable of easily controlling the spectral sensitivity region and available at a reduced cost, and accordingly it has been popularized rapidly for electrophotographic application use.

As such OPC photoreceptors, although there has been known a single layer type of using a polymeric charge transfer complex, a double-layered photoconductive structure in which a charge carrier generation layer and a charge carrier transport layer are laminated has often been used in view of the sensitivity characteristics and there have been proposed various combinations of an organic or inorganic charge carrier generation layer and an organic polymeric charge carrier transport layer. The organic charge carrier generation layer and organic charge carrier transport layer of this type have been formed generally by dispersing or dissolving an organic functional material such as a charge carrier generation agent or charge carrier transport agent, alone or together with a polymeric material such as a polycarbonate into a solvent and then coating it on the surface of a substrate by means of dipping method or spraying method. However, the method of using the solvent has a problem that the solvent has to be selected so that respective layers are not dissolved to each other and a homogenous coating film can not be obtained easily since it is difficult to maintain coating conditions, as well as it has a disadvantage, for example, that an enormous installation cost is required for avoiding explosion danger or injury to health caused by the solvent vapor.

On the contrary, since a vacuum vapor deposition method used for forming inorganic charge carrier generation layers does not require any solvent, there has been proposed a method of forming a charge carrier generation layer by vapor-depositing under vacuum an organic compound, for example, anthrathene, naphthoquinone, pyrene, perylene, phthalocyanine and cyanine pigments. Such a charge carrier generation layer can function sufficiently at a thickness of less than about several μm. However, if it is disposed on the surface of a photoreceptor, it is easily abrased resulting in degradation of the property. Accordingly, a charge carrier generation layer is at first disposed on a substrate and subsequently, a charge transport layer of greater thickness is laminated thereover to protect the charge carrier generation layer from abrasion.

But, the charge carrier generation layer disposed on the substrate has a problem that charge injection tends to occur from the electroconductor layer on the substrate to photocarriers, i.e., hole-electron pairs, generated under irradiation of light, thereby offsetting charges on the surface of the photoreceptor and making it difficult for the carrier transport, and the increase of the potential at a light area and the change of potential at a dark area arise when using over again. For preventing such a disadvantageous phenomena, it has been known effective to apply an insulative subbing layer of about 0.1 to 5 μm in thickness between the electroconductor of the substrate and the charge carrier generation layer.

The subbing layer in such an OPC photoreceptor is formed, for example, by applying a coating material obtained by dissolving a polymeric material such as polycarbonate into a solvent to the surface of the substrate by means of dipping method or spraying method in either case where the charge generation layer is formed by vacuum vapor deposition method or solution coating method. However, the method of using the solution-type coating material has a problem that a solvent has to be selected such that respective layers are not dissolved to each other, and that a homogenous coating film can not be obtained easily since it is difficult to maintain the coating conditions, as well as has a disadvantage that an enormous installation cost is required for avoiding problems of explosion danger or injury to health caused by solvent vapor.

Then, upon coating the subbing layer, if the surface of the substrate is too smooth, it results in uneven sensitivity characteristics since it is difficult to make the thickness of the coating layer uniform. On the other hand, if the surface of the substrate is too rough, since the coating thickness has to be increased, the efficiency is poor in the coating and drying steps and, in addition, it is not preferred in view of the sensitivity characteristics. Accordingly, there has been a disadvantage that the surface roughness of the substrate has to be adjusted at a high accuracy such that it is within an optimum range.

In addition, there is also a drawback that the subbing layer formed by coating has no sufficient close bondability with the charge carrier generation layer formed thereover by vacuum vapor deposition.

Further, there has been proposed a method of forming the organic charge carrier transport layer also by vacuum vapor deposition in the same manner as described above.

One of them is a proposal of forming an organic charge carrier transport layer by means of vacuum vapor deposition of a poly-p-phenylene sulfide film (Japanese Patent Application Laid-Open (KOKAI) No. 60-59353), but this film has a drawback that it is highly electrically insulative and the spectral transmittance in the visible ray region is poor. Furthermore, it is difficult for co-evaporation of the charge carrier transfer agent and it has not yet been put to practical use.

Furthermore, it has been proposed a method of vapor-depositing under vacuum respective starting materials such as polyimide and polyamide on a substrate, heat-polymerizing them to form a polyimide and polyamide film (Japanese Patent Application Laid-Open (KOKAI) No. 50-197730; Iijima, et al: "Vacuum", vol., 28, No. 5 (1985)). However, the layer can not be used as a charge carrier transport layer since it has high electric insulation and show poor its optical transmittance, and the charge carrier transporting agent is destructed if it can be co-evaporated under vacuum, upon polymerization of the film.

In view of the above, the present inventors have studied the formation of a vapor deposition film of a polycarbonate, such polycarbonate having been known as a vehicle for the formation of a subbing layer or a charge transport layer by the solution coating method.

However, if general-purpose polycarbonate is used for vacuum vapor deposition, only a film with a molecular weight of not greater than 2,000 can be obtained, which is insufficient for the close bondability with the substrate or the scratch resistance and can not be put to practical use. Further, if it is intended to vapor-deposit under vacuum a bishydroxy compound and a carbonic acid ester respectively as the starting material for the ester-exchange synthesis of polycarbonate, the homogenous vacuum vapor deposition is not possible due to excess difference in the vapor pressure and it has a drawback of contaminating the inside of a vacuum vapor deposition device making it impossible for practical use.

Then, as a result of the present inventors' further studies, it has been found that vacuum vapor deposition film of the polycarbonate can be formed by using an oligomer synthesized previously by an ester-exchanging process of a bishydroxy compound and a carbonic acid ester as a evaporation source for the polycarbonate. The present invention has been accomplished based on such a finding.

SUMMARY OF THE INVENTION

In a first aspect of the present invention, there is provided an electrophotographic photoreceptor comprising a charge carrier generation layer and a charge carrier transport layer disposed in this order on a substrate, in which at least one of said charge carrier generation layer and said charge carrier transport layer is a vacuum vapor deposition film containing a binding polymer.

In a second aspect of the present invention, there is provided a method of manufacturing an electrophotographic photoreceptor as defined in the first aspect, which comprises:

(1) forming a charge carrier generation layer by simultaneously vapor-depositing under vacuum a charge carrier generation material and a precursor of a binding polymer on a substrate, and then forming a charge carrier transport layer;

(2) forming a charge carrier generation layer on a substrate and then simultaneously vapor-depositing under vacuum a charge carrier transport material and a precursor of a binding polymer, thereby forming a charge carrier generation layer; or (3) forming a charge carrier generation layer by simultaneously vapor-depositing under vacuum a charge carrier generation material and a precursor of a binding polymer on a substrate and, thereafter, forming a charge carrier generation layer by simultaneously vapor-depositing under vacuum a charge carrier transport material and a precursor of a binding polymer.

DETAILED DESCRIPTION OF THE INVENTION

An electrophotographic photoreceptor according to the present invention can be manufactured by using at least one of methods of (i) forming a charge carrier generation layer by simultaneously vapor-depositing (co-evaporating) under vacuum a charge carrier generation material and a precursor of a binding polymer on a substrate; (ii) vapor-depositing under vacuum only a precursor of a binding polymer on a substrate at the initial stage thereof and, subsequently, forming a charge carrier generation layer by simultaneously vapor-depositing under vacuum a charge carrier generation material and a precursor of a binding polymer thereon; or (iii) forming a charge carrier transport layer by simultaneously vapor-depositing under vacuum a charge carrier transport material and a precursor of a polymer binder on a charge carrier generation layer.

Accordingly, for the electrophotographic photoreceptor according to the present invention, there can be mentioned, for example, such a constitution, in which (1) a charge carrier generation layer containing a binding polymer is sandwiched between a substrate and a known charge carrier transport layer;

(2) a known charge carrier generation layer is sandwiched between a substrate and a charge carrier transport layer containing a binding polymer; or (3) a charge carrier generation layer containing a binding polymer is sandwiched between a substrate and a charge carrier transport layer containing a binding polymer.

There is no particular restriction for the binding polymer used for the electrophotographic photoreceptor according to the present invention, but there can be mentioned, for example, polycarbonate, polyamide, polyimide, polyallylate, polyphenylenesulfide, polyvinyl carbazole, polystyrene and urea resin, and polycarbonate is preferred. Further, as a precursor for the binding polymer suitable to the formation of a vacuum vapor deposition film containing the binding polymer in the present invention, carbonate oligomer, amide oligomer, imide oligomer, allylate oligomer, phenylenesulfide oligomer, vinyl carbazole oligomer, styrene oligomer and urea oligomer may be used, and a liquid carbonate oligomer is suitable. Such a liquid carbonate oligomer can be prepared by polycondensating a mixture of a bishydroxy compound such as bisphenol-A and a carbonic acid ester such as diphenyl carbonate as the starting material for the synthesis of polycarbonate by means of an ester exchanging reaction. The reaction conditions such as a temperature of higher than 200° C. under a reduced pressure, preferably a temperature of 200°-350° C. under 0.1-10 mmHg may be used, for removing the hydroxy compound which is split-off upon polycondensation out of the system.

There is no particular restriction for the molecular weight (weight average) of the liquid carbonate oligomer thus obtained, and it is, preferably, from about $10^3$ to $10^4$, more preferably from 1,000 to 5,000 (viscosity of 10-10,000 poise) since polymerization after vacuum vapor deposition tends to be insufficient if the molecular weight is too low, whereas vacuum vapor deposition can not proceed effectively if it is too high.

Further, such a carbonate oligomer may be prepared by polycondensating reaction under the coexistence of a charge carrier generation material or a charge carrier transport material, in which a composition for vacuum vapor deposition containing a charge carrier generation material and an oligomer, or a composition for vacuum vapor deposition containing a charge carrier transport material and an oligomer can be obtained all at once.

There is no particular restriction for the charge carrier generation material used for preparing the electrophotographic photoreceptor in the present invention so long as it can be vapor deposited under vacuum. For example, copper phthalocyanine or titanyl phthalocyanine may be exemplified. The charge carrier generation material can properly be selected and used as a single composition for vacuum vapor deposition by blending the precursor for the binding polymer such as a carbonate oligomer as described above or can be used as separate evaporation sources respectively without blending.

As the known charge carrier generation layers, there can be mentioned, for example, titanyl phthalocyanine vapor deposition layer (Japanese Patent Application Laid-Open (KOKAI) No. 59-166959) and titanyl phthalocyanine dispersion type (Japanese Patent Application Laid-Open (KOKAI) No. 61-109056).

The charge carrier transport material used for preparing the electrophotographic photoreceptor in the present invention may be those which can be used in combination with a binder such as a polycarbonate in the conventional solution coating method, for example, stilbenes, hydrazones or pyrazolines. An appropriate charge carrier transport material may be selected and used as a single composition for vacuum vapor deposition by blending with a precusor of a binding polymer such as a carbonate oligomer as described above or can be used by using them as separate evaporization sources respectively without bending.

As the known charge carrier transport layer, there can be mentioned, for example, stilbene dispersed polycarbonate (refer to Japanese Patent Publication No. 60-58469, Japanese Patent Publication No. 62-35672 and Japanese Patent Publication No. 62-35673) or hydrazone dispersed polycarbonate (refer to Japanese Patent Application Laid-Open (KOKAI) No. 61-270765 and Japanese Patent Application Laid-Open (KOKAI) No. 63-271459).

The substrate used for preparing the electrophotographic photoreceptor in the present invention may be the same substrate as used in conventional electrophotographic photoreceptors, with no particular restrictions, and there can be mentioned, for example, Al. Further, such a substrate may be applied with the same pre-treatment as in the conventional electrophotographic photoreceptor, and may or may not be formed with a subbing layer. The subbing layer on the substrate can be formed by vapor depositing under vacuum a precursor of a binding polymer such as the carbonate oligomer.

The charge carrier generation layer may be formed on the substrate in the present invention by co-evaporation using a precursor of the binding polymer, for example, a carbonate oligomer and a charge carrier generation material respectively as separate evaporization sources in a vacuum vapor deposition device, or vacuum vapor deposition may be applied by using a composition for vacuum vapor deposition containing both of them as a single evaporization source in a vacuum vapor deposition device. Further, when the charge carrier generation layer is vapor-deposited under vacuum by at first vapor-depositing previously under vacuum a precursor if a binding polymer to form a polymeric layer of a uniform thickness on a substrate and then successively vapor-depositing under vacuum a precursor of the binding polymer and a charge carrier generation material simultaneously, an electrophotographic photoreceptor can be obtained also by vapor-depositing under vacuum the charge carrier generation layer directly on the substrate not formed with a subbing layer in the same way as in the case of forming the charge carrier generation layer after forming the subbing layer on the substrate. Further, the operation conditions for practicing such vacuum vapor deposition are preferably selected properly such that the thickness or other properties of the vacuum vapor deposition layer are within a desired range and effective operation is enabled, and vacuum vapor deposition is conducted, for example, at $10^{-1}$ to $10^{-5}$ mmHg and 200° C. to 600° C.

In the present invention, after forming a charge carrier generation layer on a substrate, a charge carrier transport layer is further laminated thereover, in which the charge carrier transport layer may be formed by the conventional method, that is, by coating, but it is preferable that the charge carrier transport layer is formed by vacuum vapor deposition using the same method as that for forming the charge carrier generation layer.

For forming the charge carrier transport layer by means of vacuum vapor deposition in the present invention, it is preferred to use a method of vapor-depositing under vacuum a charge carrier transport material and a precursor of a binding polymer simultaneously, which may be conducted by using the charge carrier transport material and the precursor of the biding polymer respectively as separate evaporization sources in an evaporization device or by using a composition for vacuum vapor deposition containing a charge carrier transport material and a precursor of a binding polymer as a single evaporization source in a evaporization device. As the precursor of the binding polymer, the same precursor of the binding polymer as used for the formation of the charge carrier generation layer can be used and, among all, liquid carbonate oligomer is particularly preferred.

Further, in the present invention, the vacuum vapor deposition conditions for forming the respective layers are preferably selected property such that the thickness and other conditions of the vacuum vapor deposition layer are within a desired range and effective operation can be conducted.

In the electrophotographic photoreceptor according to the present invention, uniform thickness and uniform electrical property can be obtained by forming the charge carrier generation layer by means of vacuum vapor deposition and the charge carrier generation layer firmly adheres to a substrate or a subbing layer disposed thereon and can provide excellent adherence to the charge carrier transport layer as well. Further, the charge carrier transport layer formed by vacuum vapor deposition has uniform thickness and uniform electrical property irrespective of the shape of the substrate and, in addition, shows a performance equal with or superior to that of the electrophotographic photoreceptor prepared by the conventional solution coating method.

The electrophotographic photoreceptor according to the present invention has no requirement for making the surface roughness of the substrate greater, shows good bondability even without additionally disposing a subbing layer and satisfactory sensitivity characteristic. Further, it is excellent in the smoothness of the surface, shows uniform film thickness and requires no levelling treatment. Then, since most of the manufacturing steps are conducted by the operations in a tightly closed device, there are merits free from the generation of defects due to the deposition of dusts, etc. satisfactory image quality of coped images causing no degradation of the image quality.

For instance, the photoreceptor has a surface smoothness (surface roughness) Rz of not less than 0.01 μm, the charge retainability (surface potential)$V_M$ of from 800 to 1000 V, the sensitivity $E_{\frac{1}{2}}$ of from 0.3 to 0.5 lux. sec and the repeating characteristics of the initial increase of the residual potential of 0 to 10 V and the residual potential increase after repeating 1000 cycles of not greater than 50 V at the charging potential of 900–1000 V.

Further, according to the manufacturing method of the electrophotographic photoreceptor in the present invention, since solvent, etc. are not used, there is no requirement for the drying equipment or a solvent recovery equipment for the prevention of public pollutions, by which the production facility can be simplified and rationalized, as well as the step operations are made easy and automation steps can also be facilitated.

EXAMPLES

The present invention will be more precisely explained while referring to Examples as follows.

However, the present invention is not restricted to examples under mentioned. From the foregoing description one skilled in the art can easily ascertain the essential characteristics of the present invention, and without departing from the spirit and scope thereof, can make various changes and modifications of the invention to adapt it to various usages and conditions.

EXAMPLE 1

2,2-bis(4-hydroxyphenyl)propane (hereinafter referred to as bisphenol-A) and diphenyl carbonate were charged in an equi-molar ratio into an ampoule tube made of glass connected to an exhaust device, heated at 350° C. while reducing the pressure to 1 Torr for 4 hours and allowed to cool, thereby obtaining a liquid carbonate oligomer of extremely high viscosity [molecular weight (weight average): 5,000]

Meanwhile, an aluminum tube, which was mirror finished at the surface so as to have a smoothness with a surface roughness of not greater than 0.2 μm, was placed as a photoreceptor substrate in a vacuum vapor deposition device. Titanyl phthalocyanine was charged as a charge generation material and the liquid carbonate oligomer as described above was charged as a precursor for a binding polymer, respectively, into separate evaporators disposed in the same vacuum vapor deposition device. After setting the vacuum degree to higher than $10^{-4}$ Torr, both of the evaporators were heated simultaneously to form a charge generation layer of about 1 μm in thickness by vacuum vapor deposition. The temperature of the evaporization source of the charge generation material was 450° C., the temperature of the evaporization source of the carbonate oligomer was 300° C. and the time for the vacuum vapor deposition was 5 min.

The photoreceptor substrate disposed with the charge generation layer without a subbing layer was taken out of the vacuum vapor deposition device, to which a coating material prepared by dissolving one part by weight of a polycarbonate resin (Yupiron S 3000N, prepared by Mitsubishi Gas Kagaku Co.) as a binder and one part by weight of stilbene as the charge transport material into 48 parts by weight of methylene chloride as a solvent, was applied by dip coating to obtain an electrophotographic photoreceptor A having a charge transport layer of 20 μm thickness laminated thereon.

EXAMPLE 2

In accordance with the same procedures as those in the preparation of the liquid carbonate oligomer in Example 1, titanyl phthalocyanine was further added by the same weight as the total amount for bisphenol-A and diphenyl carbonate and they were reacted by heating under a reduced pressure, thereby obtaining a liquid carbonate oligomer composition containing titanyl phthalocyanine.

Then, the same aluminum tube as used in Example 1 was placed in a vacuum vapor deposition device and the liquid carbonate oligomer composition was charged in one evaporator and vacuum vapor deposition was applied quite in the same procedures as those in Example 1 except for changing the temperature of the evaporization source to 350° C. and the time for the vacuum vapor deposition to 10 min, thereby obtaining a charge generation layer of about 1 μm in thickness.

The photoreceptor substrate disposed with the charge generation layer without a subbing layer was taken out of the vacuum vapor deposition device and then an electrophotographic photoreceptor B having a charge transport layer of 20 μm in thickness laminated thereover was obtained by coating quite in the same procedures as those in Example 1.

EXAMPLE 3

Vacuum vapor deposition was applied to an aluminum tube quite in the same procedures as those in Example 1 except for using an azo dye (the same dye as described in U.S. Pat. No.4,242,260 and U.S. Pat. No.4,242,598) instead of using titanyl phthalocyanine as a charge generation material, the temperature of the evaporization source of the charge generation material was 300° C., the time for the vacuum vapor deposition was 5 min and the thickness of the charge generation layer obtained was about 1 μm.

The photoreceptor substrate disposed with the charge generation layer without a subbing layer was taken out of the vacuum vapor deposition device and an electrophotographic photoreceptor C having the charge transport layer of 20 μm thickness laminated thereover by coating was obtained quite in the same procedures as those in Example 1.

EXAMPLE 4

The liquid carbonate oligomer composition containing titanyl phthalocyanine obtained in Example 2 was charged into one of separate evaporators disposed in a vacuum vapor deposition device, while an equi-weight mixture of stilbene as the charge transport material and the liquid carbonate oligomer obtained in Example 1 was charged into the other of the evaporators and, at first, a photoreceptor substrate formed with the same charge generation layer as prepared in Example 2 was obtained by the same procedures as those in Example 2.

Successively, the evaporator charged with the mixture of the charge transport material and the carbonate oligomer was heated to 400° C. and vacuum vapor deposition was applied for 20 min to obtain an electrophotographic photoreceptor D having a charge transport layer of 20 μm in thickness laminated thereover was obtained.

COMPARATIVE EXAMPLE 1

An aluminum tube prepared so as to have a surface roughness of 0.7 μm was used as a photoreceptor substrate, to which a coating material prepared by dissolving one part by weight of a polyamide resin (Torejin F 300, manufactured by Teikoku Kagaku Sangyo Co.) into 49 parts by weight of methanol was applied by dip-coating to form a subbing layer of 5 μm in thickness.

Then, it was dipped into a liquid prepared by dispersing and dissolving one part by weight of polyvinyl butyral and 2 part by weight of titanyl phthalocyanine into 50 parts by weight of 4-methoxy-4-methylpantanone, and dried to form a charge generation layer of about 1 μm in thickness.

Further, in accordance with the same procedures as those in Example 1, an electrophotographic photoreceptor E having a charge transport layer of about 20 μm in thickness laminated thereover was obtained.

TEST EXAMPLE 1

For the electrophotographic photoreceptors obtained in the Examples and the Comparative Example, surface smoothness, charge retainability, sensitivity, repeating characteristics and image quality at high humidity were measured respectively by the following methods, and the results of the evaluation for the performance of products according to the present invention relative to control products are shown in Table 1.

Surface Smoothness

Smoothness was measured by using a surface roughness gauge. The surface smoothness Rz of 0.01–0.1 μm, more preferably 0.01–0.05 μm is preferred.

Charge Retainability

A drum checker for electrophotographic photoreceptor was used and the state of potential maintained at the surface of the photoreceptor was measured at a charge current of 100 μA. The charge retainability of 800–1,000 V is preferred.

Sensitivity

Light at an exposure dose of 10 lux was irradiated by using a drum checker and a time at which the potential wa decayed to ½ was measured. The time ($E_{\frac{1}{2}}$) of 0.3 to 0.5 lux. sec is preferred.

Repeating Characteristics

Charging and exposure were repeated for 1000 cycles by using a drum checker and the increasing tendency of the residual potential upon exposure was measured at the charged potential of 900 to 1000 V. The increased residual potential of less than 50 V is preferred.

Image Quality at High Humidity

Copying was conducted by using a copying machine (FT-4820 manufactured by Ricoh Co.) under the circumstantial condition of 90% relative humidity and the quality of the copied images was evaluated in comparison.

TABLE 1

| Electrophotographic Photoreceptor | A | B | C | D | E |
|---|---|---|---|---|---|
| Surface smoothness Rz(μm) | 0.01 | 0.01 | 0.01 | 0.01 | >0.05 |
| Charge retainability $V_M$(V) | 900–1,000 | 900–1,000 | 900–1,000 | 900–1,000 | 800–900 |
| Sensitivity (lux. sec) $E_{\frac{1}{2}}$ | 0.3–0.5 | 0.3–0.5 | 0.3–0.5 | 0.3–0.5 | 0.3–0.5 |
| Repeating characteristics: (Residual potential (V)) | | | | | |
| Initial stage | 0–10 | 0–10 | 0–10 | 0–10 | 0–10 |
| After 1000 cycles | 30–40 | 30–40 | 30–40 | 30–40 | 50–55 |
| Image quality at high humidity | ∘ | ∘ | ∘ | ∘ | ∘ |

TABLE 1-continued (Note)
Symbols for the evaluation have the following meanings.
◎ : excellent,
∘ : equivalent to the electrophotographic photoreceptor
Δ : somewhat poor From the results of the evaluation, it can be seen that the charge generation layer in the electrophotographic photoreceptor prepared by the vacuum vapor deposition method according to the present invention has excellent performance as compared with the conventional charge generation layer obtained by the wet process using a paint.

EXAMPLE 5

A liquid carbonate oligomer of extremely high viscosity [molecular weight (weight average): 5,000] was obtained quite in the same procedures as those in Example 1.

Meanwhile, an aluminum plate as a substrate was mounted in a vacuum vapor deposition device, and copper phthalocyanine was vapor-deposited under vacuum to a thickness of 0.1 μm to form a charge generation layer. Subsequently, stilbene as the charge transport material and the liquid carbonate oligomer described above as the binder charged respectively into separate evaporators disposed in the same vacuum vapor deposition device were simultaneously vapor deposited under vacuum respectively. The vacuum degree in this case was higher than $10^{-4}$ Torr, the temperature of the evaporation source of stilbene was 150° C., the temperature of the evaporation source of the carbonate oligomer was 400° C. and the time for the vapor deposition was 30 min.

The thickness of the charge transport layer in the electrophotographic photoreceptor F obtained was about 30 μm and the ratio of the charge transport material to the binder in the charge transport layer was about 1:1 by weight.

EXAMPLE 6

In accordance with the same procedures as those in the preparation of the liquid carbonate oligomer in Example 5, stilbene was further added by the same weight as the total amount for bisphenol-A and diphenyl carbonate and reacted by heating under a reduced pressure, thereby obtaining a liquid carbonate oligomer composition containing stilbene.

Subsequently, the liquid carbonate oligomer composition was vapor deposited on a substrate disposed with the same charge generation layer as used in Example 5 quite in the same manner as in Example 5 except for changing the temperature of the evaporization source to 400° C. and the time for vapor deposition to 30 min.

The thickness of the charge transport layer in the electrophotographic photoreceptor G obtained was about 30 μm.

COMPARATIVE EXAMPLE 2

A paint for forming a charge transport layer was prepared by dissolving one part by weight of a polycarbonate resin (Yupiron S-3000 N, manufactured by Mitsubishi Gas Kagaku Co.) as the binder and one part by weight of stilbene as the charge transport material into 48 parts by weight of methylene chloride as a solvent.

The paint was spray-coated and dried on a substrate disposed with the same charge generation layer as used in Examples 5 and 6.

The thickness of the charge transport layer in the electrophotographic photoreceptor H obtained was about 30 μm.

TEST EXAMPLE 2

For the electrophotographic photoreceptors in the Examples and Comparative Example described above, when the close bondability and the surface hardness of the charge transport layers were examined, it was found that all of them had similar properties.

Further, the electrophotographic photoreceptors according to the present invention were apparently excellent for the surface smoothness.

Further, characteristics were evaluated by using an Electrostatic Paper Analyzer (SP 428, manufactured by Kawaguchi Denki Co.). In the test, the electrophotographic photoreceptor was negatively charged and the decay of the surface charges upon irradiation of light to the surface was measured and an exposure amount (lux. sec) with which the surface charge was reduced to ½ of the initial value was determined as the sensitivity ($E_{\frac{1}{2}}$). Further, a potential value decayed after leaving in a dark place for 20 sec after the charging ($V_{20}$) was measured and the value obtained by dividing the measured value with the initial potential value ($V_0$) was determined as a dark decay ratio. The results of the measurement were as shown in Table 2.

TABLE 2

| Photoreceptor | Sensitivity ($E_{\frac{1}{2}}$) (Lux. sec) | Dark decay ratio |
|---|---|---|
| F | 8.1 | 0.86 |
| G | 7.9 | 0.85 |
| H | 8.0 | 0.84 |

From the results, it can be seen that the electrophotographic photoreceptors according to the present invention have performance as comparable with that of the electrophotographic photoreceptor prepared by the conventional method.

What is claimed is:

1. A method for manufacturing an electrophotographic photoreceptor comprising a substrate, a charge generation layer disposed on the substrate and a charge transport layer disposed on the charge generation layer, said method comprising:

simultaneously vapor-depositing under vacuum a charge generation material and a liquid carbonate oligomer having a weight average molecular weight of from about $10^3$ to $10^4$ on said substrate to form said charge generation layer, and simultaneously vapor-depositing under vacuum a charge transport material and said liquid carbonate oligomer having a weight average molecular weight of from about $10^3$ to $10^4$ on said charge generation layer to form said charge transport layer.

2. A method for manufacturing an electrophotographic photoreceptor comprising a substrate, a charge generation layer disposed on the substrate and a charge transport layer disposed on the charge generation layer, said method comprising:

forming said charge generation layer on said substrate, and simultaneously vapor-depositing under vacuum a charge transport material and a liquid carbonate oligomer having a weight average molecular weight of from about $10^3$ to $10^4$ on said charge generation layer to form said charge transport layer.

3. The method of claim 2, wherein said charge generation layer is formed by vacuum vapor deposition.

4. A method for manufacturing an electrophotographic photoreceptor comprising a substrate, a charge generation layer disposed on the substrate and a charge transport layer disposed on the charge generation layer, said method comprising:

simultaneously vapor-depositing under a vacuum a charge generation material and a liquid carbonate oligomer having a weight average molecular weight of from about $10^3$ to $10^4$ on said substrate to form said charge generation layer, and forming said charge transport layer on said charge generation layer.

5. The method of claim 4, wherein said charge transport layer is formed by vacuum vapor deposition.

6. The method of claim 4, 2 or 1, wherein said liquid carbonate oligomer is prepared by heating a mixture of a bishydroxy compound and a carbonic acid ester under reduced pressure.

7. The method of claim 4, 2 or 1, further comprising the step of forming a subbing layer containing a binding polymer between the substrate and the charge generation layer.

8. The method of claim 7, wherein said binding polymer is selected from the group consisting of polycarbonate, polyamide, polyimide, polyallylate, polyphenylenesulfide, polyvinyl carbazole, polystyrene and urea resin.

9. The method of claim 7, wherein said subbing layer is formed by vapor-depositing under vacuum a precursor of the binding polymer.

10. The method of claim 9, wherein said precursor is selected from the group consisting of carbonate oligomer, amide oligomer, imide oligomer, allylate oligomer, phenylenesulfide oligomer, vinyl carbazole oligomer, styrene oligomer and urea oligomer.

11. The method of claim 10, wherein said precursor is a liquid carbonate oligomer.

12. The method of claim 4 or 1, wherein said charge generation material is copper phthalocyanine or titanyl phthalocyanine.

13. The method of claim 4, 2 or 1, wherein said vapor-depositing is conducted under a vacuum of from $10^{-1}$ to $10^{-5}$ mmHg and at a temperature of from 200° C. to 600° C.

14. The method of claim 4 or 1, wherein said charge generation material and said liquid carbonate oligomer are blended and co-evaporated as a single evaporation source.

15. The method of claim 2 or 1, wherein said charge transport material and said liquid carbonate oligomer are blended and co-evaporated as a single evaporation source.

16. The method of claim 4 or 1, wherein said charge generation material and said liquid carbonate oligomer are vapor-deposited as separate evaporation sources.

17. The method of claim 2 or 1, wherein said charge transport material and said liquid carbonate oligomer are vapor-deposited as separate evaporation sources.

18. The method of claim 6, wherein said bishydroxy compound is bisphenol A and said carbonic acid ester is diphenyl carbonate.

* * * * *